US006523501B1

(12) United States Patent
Bloch

(10) Patent No.: US 6,523,501 B1
(45) Date of Patent: Feb. 25, 2003

(54) DEVICE FOR SUPPORTING AN INDIVIDUAL REQUIRING ASSISTANCE

(76) Inventor: Richard I. Bloch, 4335 Cathedral Ave. NW., Washington, DC (US) 20016

( * ) Notice: Subject to any disclaimer, the term of this patent is extended or adjusted under 35 U.S.C. 154(b) by 240 days.

(21) Appl. No.: 09/593,036

(22) Filed: Jun. 13, 2000

Related U.S. Application Data

(60) Provisional application No. 60/175,417, filed on Jan. 11, 2000.

(51) Int. Cl.[7] ..... A62B 35/00
(52) U.S. Cl. ..... 119/857
(58) Field of Search ..... 119/857, 770; 482/122, 124; 623/58

(56) References Cited

U.S. PATENT DOCUMENTS 5,101,768 A * 4/1992 Cates ..... 119/770
5,435,272 A * 7/1995 Epstein ..... 119/857
5,619,955 A * 4/1997 Nelson ..... 119/857
5,795,274 A * 8/1998 Kasbohm ..... 482/124
6,062,173 A * 5/2000 Heinrichs ..... 119/770
6,125,792 A * 10/2000 Gee ..... 119/857

* cited by examiner

*Primary Examiner*—Charles T. Jordan
*Assistant Examiner*—Elizabeth Shaw
(74) *Attorney, Agent, or Firm*—Pillsbury Winthrop LLP

(57) ABSTRACT

An adjustable waistband, adapted to be worn by a caregiver, is provided with a support plate located at the caregiver's side when the waistband is worn. An adjustable strap is joined to the support plate in a manner which permits the strap to pass over the caregiver's shoulder on the opposite side from where the plate is located. A brace is secured to the support plate to receive a body part of a person needing assistance whereby weight of that person which is imposed on the brace is distributed onto the caregiver by the strap and waistband.

10 Claims, 3 Drawing Sheets

DEVICE FOR SUPPORTING AN INDIVIDUAL REQUIRING ASSISTANCE

This application claims the benefit of Provisional application No. 60/175,417, filed Jan. 11, 2000.

BACKGROUND OF THE INVENTION

1. Field of the Invention

The present invention relates to a device worn by a caregiver to distribute the weight of a disabled person borne by the caregiver as support assistance is being provided to the disabled person.

2. Prior Art

When a person incapable of bearing his or her own weight is lifted and is supported in a upright position by a caregiver, the disabled person's weight typically is applied to the caregiver's arms. If such weight is borne by the caregiver for an extended period of time, such support becomes very tiring to the caregiver.

Various appliances have been developed to provide support assistance to a disabled person. Typically, such appliances are devices which serve to support the persons using them as they grasp or rest on the devices. Examples are crutches, walkers and the like. Another type of support appliance is a harness arrangement worn by the person requiring assistance. The harness often has attached thereto a member which provides support for a body part. Other types of harnesses are intended to support the body weight of a user as the harness is held by another individual or by a weight-bearing frame.

The present invention is directed to a harness arrangement intended to be worn by a caregiver to support the weight of a disabled person which is applied to the harness. Such an arrangement distributes the weight as it is applied to the harness so as to make the effort of supporting the disabled person less tiring on the caregiver.

SUMMARY OF THE INVENTION

The present invention comprises an adjustable waistband adapted to be worn by the caregiver. A plate is secured to the waistband at a position located on one side of the caregiver as the waistband is being worn. The plate receives the ends of an adjustable strap which passes over the caregiver's shoulder on the opposite side from where the plate is located. Additionally, an arm brace is secured to the outer surface of the plate so as to be disposed substantially horizontally when the waistband is being worn by the caregiver. When a disabled person's arm is positioned within the brace as that person is lifted and supported in an upright position, his or her weight is transmitted by the plate and strap to the caretaker's body. By virtue of the strap's position, the weight is distributed so as to reduce the effort required by the caregiver to support the disabled person for an extended period of time.

The invention is particularly suited to permitting a disabled person to engage in an activity such as ice skating. In such a case, two caregivers typically support the disabled individual, each caregiver wearing a support device of the type just described and being positioned on opposite sides of the individual. With the arms of the disabled person inserted in the respective braces of the two support devices, that person's entire weight can be borne easily by the two caregivers as they move across the ice surface. If the disabled individual is provided with ice skates which rest on the ice during such movement, the individual is provided with the pleasure of experiencing an activity which otherwise would be unavailable to him or her.

BRIEF DESCRIPTION OF THE DRAWINGS

The invention now will be described in greater detail with respect to the accompanying drawings, wherein.

DETAILED DESCRIPTION OF PREFERRED EMBODIMENTS OF THE INVENTION

Figure 1:
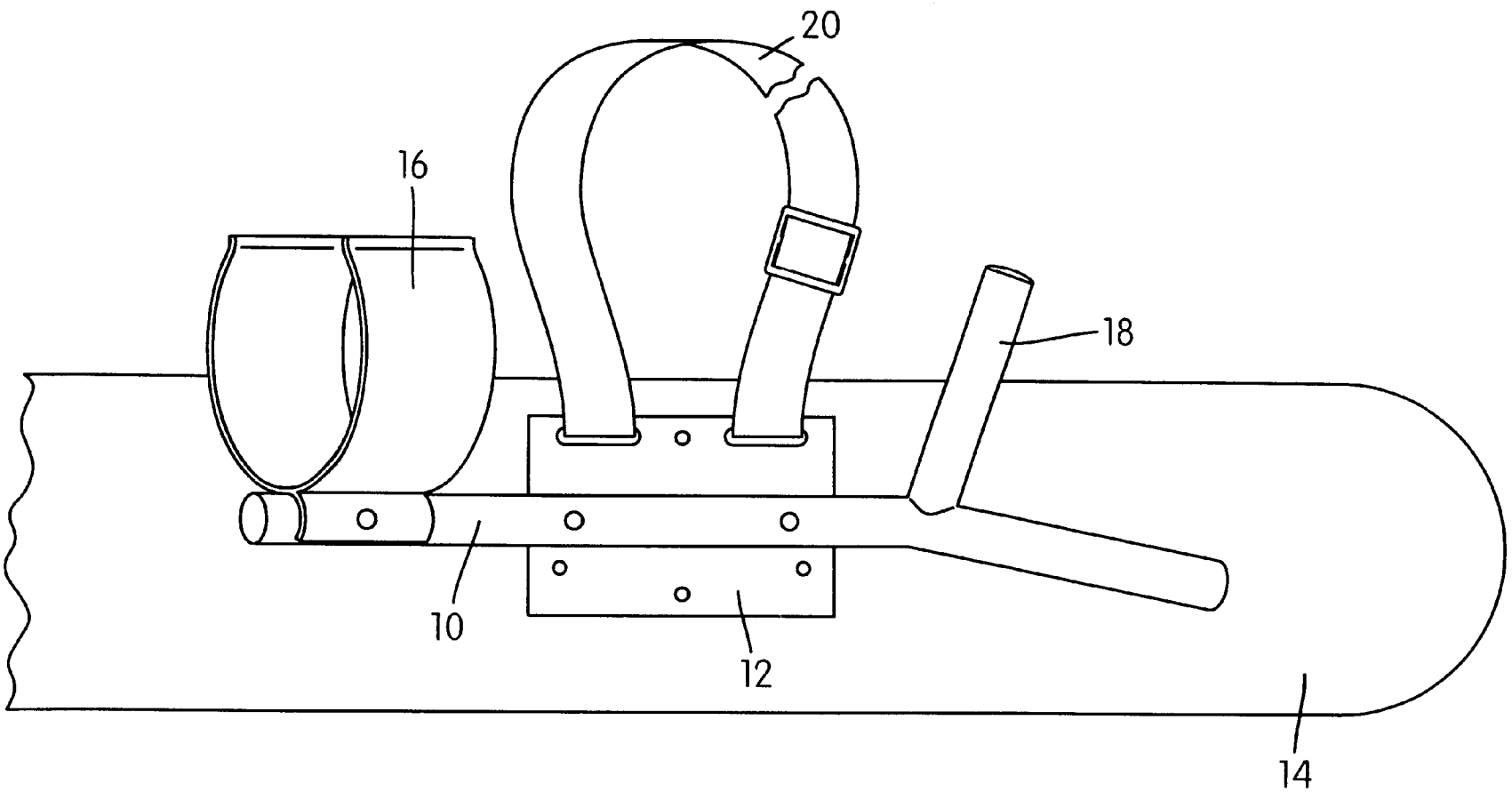
FIG. 1 is a side elevational view of a portion of a support device according to the invention.
Figure 2:
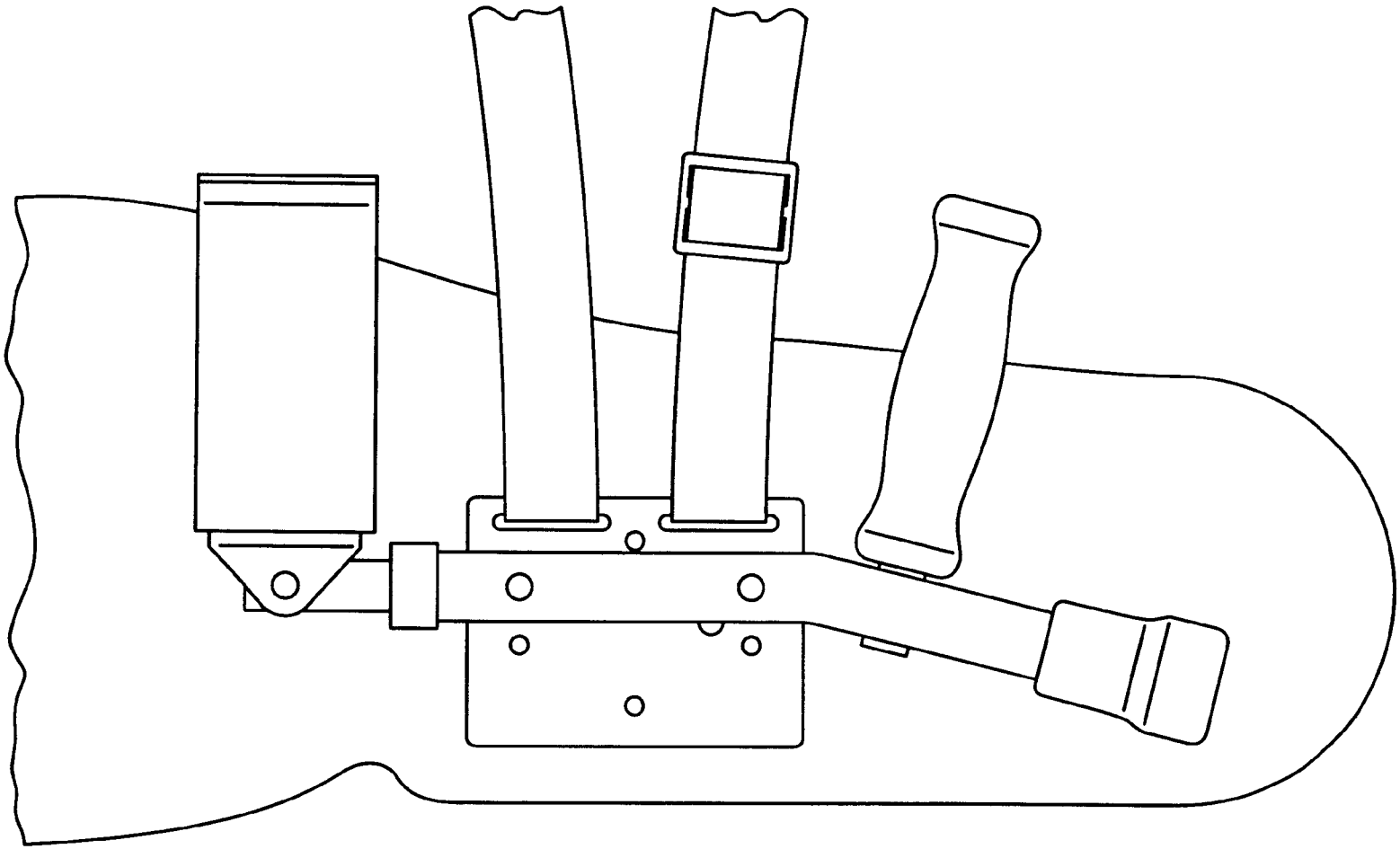
FIG. 2 is a side elevational view of an alternative embodiment of the device shown in FIG. 1.
Figure 3:
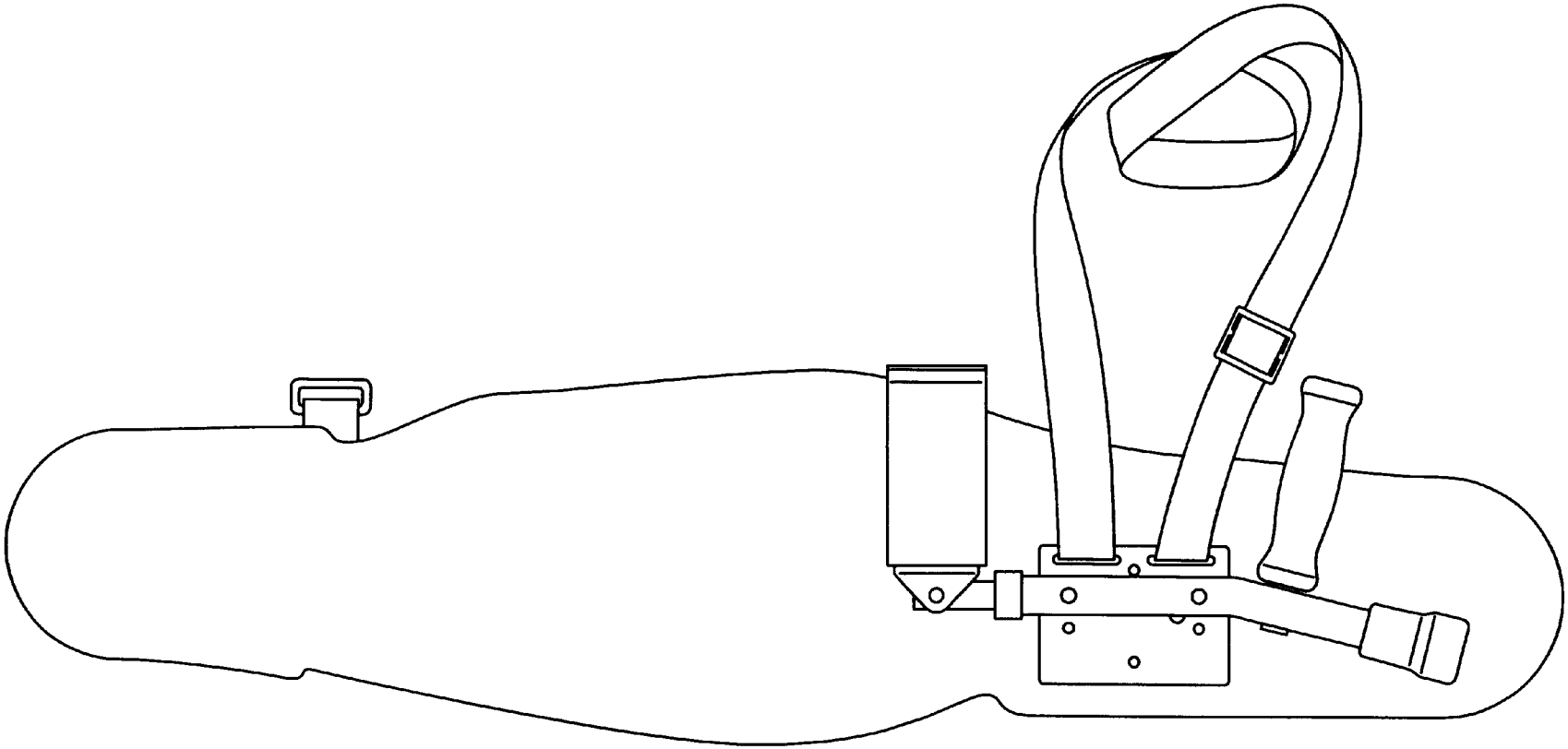
FIG. 3 is a side elevational view of the entire support device shown in FIG. 2.

Referring to FIG. 1, the support device consists of a brace 10 bolted to a metal plate 12 which is itself attached to an adjustable waistband 14. The brace is stainless steel, and includes a cuff 16 and a handgrip 18. The latter are steel, covered with form fitting plastic (FIGS. 2 and 3). The handgrip is adjustable to account for different size arms. Also attached to the metal plate is a support strap 20 that runs under a caregiver's arm, across and over his or her opposite shoulder and back to the plate. The strap is adjustable to account for different heights. When worn, the brace 10 is disposed horizontally, parallel to the floor.

As used to support a disabled person while skating, two such braces are worn, one by each of the caregivers assisting the skater. The skater inserts his or her arms through respective braces worn by the caregivers who are positioned on opposite sides of the skater. The shoulder straps support the weight of the skater, and the waistbands keep the braces stable against the bodies of the caregivers.

The brace is attached to the support plate by means of two bolts. To permit a support device to be used on opposite sides of a disabled person, the brace may be reversibly attached to the support plate. The support plate has slots drilled in it to receive ends of the strap and is secured to the waistband by means of four bolts. To improve the joinder of the brace and the waistband to the support plate, the waistband can be sandwiched between two such support plates through which the bolts pass. Of course, in this case at least the brace would be joined to the outer plate. The waistband is a conventional elastic back support with Velcro closures.

Although the present invention primarily is intended to provide support for a disabled person, it will be understood that it is equally useful in supporting an individual who is not physically disabled, but who does require assistance. For example, the device can be used when teaching ice skating to a healthy person who simply lacks the requisite coordination to be self supporting.

What is claimed is:

1. A device adapted to be worn by a first individual, the device comprising:

an adjustable waistband;

a support plate secured to the waistband at a position proximate one side of the wearer when the waistband surrounds the wearer's waist;

a brace secured to the support plate, said brace being formed to receive a body part of a second individual; and an adjustable strap joined to at least one of the waistband and the support plate and adapted to pass over the wearer's shoulder on the opposite side from where the support plate is positioned whereby weight applied by the second individual to the device via the brace is applied to the first individual in a distributed manner by the adjustable strap and the waistband.

2. A device according to claim 1, further comprising:

a second support plate secured to the first support plate with a portion of the waistband sandwiched therebetween.

3. A device according to claim 1, wherein said adjustable strap is joined to the support plate.

4. A device according to claim 2, wherein said adjustable strap is joined to at least one of the support plates.

5. A device according to claim 1, wherein said brace comprises a cuff and a handgrip secured to the support plate in positions which permit a lower arm of the second individual to be received therein in a substantially horizontal position.

6. A device according to claim 5, wherein said cuff and handgrip are positionally adjustable relative to one another.

7. A device according to claim 5, further comprising a second support plate secured to the first support plate with a portion of the waistband sandwiched therebetween.

8. A device according to claim 7, wherein said cuff and handgrip are positionally adjustable relative to one another.

9. A device according to claim 7, wherein said adjustable strap is joined to at least one of said support plates.

10. A device according to claim 9, wherein said cuff and handgrip are positionally adjustable relative to one another.

* * * * *